US006171229B1

(12) United States Patent
Kroll et al.

(10) Patent No.: US 6,171,229 B1
(45) Date of Patent: Jan. 9, 2001

(54) OSSICULAR TRANSDUCER ATTACHMENT FOR AN IMPLANTABLE HEARING DEVICE

(75) Inventors: Kai Kroll, Minnetonka; Donald J. Bushek, Plymouth, both of MN (US)

(73) Assignee: St. Croix Medical, Inc., Minneapolis, MN (US)

( * ) Notice: Under 35 U.S.C. 154(b), the term of this patent shall be extended for 0 days.

(21) Appl. No.: 08/689,308

(22) Filed: Aug. 7, 1996

(51) Int. Cl.[7] ..... H04R 25/00
(52) U.S. Cl. ..... 600/25
(58) Field of Search ..... 600/25; 607/136, 607/137, 55–57; 181/129, 130, 135, 134; 381/68–69.2

(56) References Cited

U.S. PATENT DOCUMENTS

| | | | |
|---|---|---|---|
| 3,557,775 | 1/1971 | Mahoney . | |
| 3,594,514 | 7/1971 | Wingrove | 179/107 |
| 3,712,962 | 1/1973 | Epley | 179/107 R |
| 3,764,748 | 10/1973 | Branch et al. . | |
| 3,931,648 | 1/1976 | Shea . | |
| 4,729,366 | 3/1988 | Schaefer et al. . | |
| 4,774,933 | 10/1988 | Hough et al. | 600/25 |
| 4,776,322 | 10/1988 | Hough et al. . | |
| 4,817,607 | 4/1989 | Tatge . | |
| 4,850,962 | 7/1989 | Schaefer | 600/25 |
| 4,957,478 | 9/1990 | Maniglia | 600/25 |
| 5,012,520 | 4/1991 | Steeger | 381/68 |
| 5,015,224 | 5/1991 | Maniglia | 600/25 |
| 5,015,225 | 5/1991 | Hough et al. | 600/25 |
| 5,163,957 | 11/1992 | Sade et al. | 623/10 |
| 5,277,694 | 1/1994 | Leysieffer et al. | 600/25 |
| 5,282,858 | 2/1994 | Bisch et al. | 623/10 |
| 5,338,287 | 8/1994 | Miller et al. | 600/25 |
| 5,360,388 | 11/1994 | Spindel et al. | 600/25 |
| 5,411,467 | 5/1995 | Hortmann et al. | 600/25 |
| 5,456,654 | 10/1995 | Ball | 600/25 |
| 5,498,226 | 3/1996 | Lenkauskas | 600/25 |
| 5,531,787 | 7/1996 | Lesinski et al. | 623/10 |
| 5,554,096 | 9/1996 | Ball | 600/25 |
| 5,624,376 * | 4/1997 | Ball et al. | 600/25 |
| 5,800,336 | 9/1998 | Ball et al. . | |

OTHER PUBLICATIONS

"Middle Ear Implant: Implantable Hearing Aids", *Advances in Audiology,* vol. 4, M. Hoke Series Editor, Karger, 1–169, (1988).

T. Dumon, et al., "Piezoelectric Middle Ear Implant: Experimental Results", Abstract of Paper Presented at International Symposium on Electronic Implants in Otology and Conventional Hearing Aids, Walt Disney World Swan, Abstract #35, (Nov. 11–14, 1996).

J. M. Frederickson, et al., "Ongoing Investigations into an Implantable Electromagnetic Hearing Aid for Moderate to Severe Sensorineural Hearing Loss", *Otolaryngological Clinics of North America,* vol. 28, No. 1, 107–121, (Feb. 1995).

K. Gyo, et al., "Sound Pickup Utilizing an Implantable Piezpelectric Ceramic Bimorph Element: Application to the Cochlear Implant", *American Journal of Otology,* vol. 5, No. 4, 273–276, (Apr. 1984).

K. Gyo, et al., "Stapes Vibration Produced by the Output Transducer of an Implantable Hearing Aid", *Arch Otolaryngol Head Neck Surg.,* vol. 113, 1078–1081, (Oct. 1987).

(List continued on next page.)

* cited by examiner

*Primary Examiner*—Samuel G. Gilbert
(74) *Attorney, Agent, or Firm*—Fredrikson & Byron, PA

(57) ABSTRACT

An implantable hearing aid transducer is easily mounted within a middle ear region by the force of attraction between two permanent magnets. The transducer is preferably coupled to one of the magnets prior to implantation. The transducer is coupled to the magnet by an adhesive, by a transducer case containing both the magnet and the transducer, or by being encompassed by the magnet.

11 Claims, 19 Drawing Sheets

OTHER PUBLICATIONS

G. Jako, "Biomedical Engineering in Ear Surgery", *Otolaryngological Clinics of North America,* vol. 5, No. 1, 173–182, (Feb. 1972).

Wen H. Ko, et al., "Engineering Principles of Mechanical Stimulation of the Middle Ear", *Otolaryngological Clinics of North America,* vol. 28, No. 1, 29–41, (Feb. 1995).

K. Kodera, et al., "Sound Evaluation of Partially Implantable Piezoelectric Middle Ear Implant: Comparative Study of Frequency Responses", *ENT Journal,* vol. 73, No. 2, 108–111, (Feb. 1994).

A. J. Maniglia, et al., "A Contactless Electromagnetic Implantable Middle Ear Device for Sensorineural Hearing Loss", *ENT Journal,* vol. 73, No. 2, 78–90, (Feb. 1994).

A. J. Maniglia, et al., "Contactless, Semi–Implantable Electromagnetic Hearing Device for the Treatment of Sensorineural Hearing Loss", Abstract of Paper Presented at International Symposium on Electronic Implants in Otology and Conventional Hearing Aids, Walt Disney World Swan, Abstract #28, (Nov. 11–14, 1993).

Jun–Ichi Suzuki, et al., "Long–Term Clinical Results of the Partially Implantable Piezoelectric Middle Ear Implant", *ENT Journal,* vol. 73, No. 2, 104–107, (Feb. 1994).

M. Tos, et al., "Implantation of Electromagnetic Ossicular Replacement Device", *ENT Journal,* vol. 73, No. 2, 93–103, (Feb. 1994).

D. B. Welling, et al., "Auditory Stimulation of the Inner Ear via the Semicircular Canals", Abstract of paper presented at International Symposium on Electronic Implants in Otology and Conventional Hearing Aids, Walt Disney World Swan, Abstract #9, (Nov. 11–14, 1993).

N. Yanagihara, et al., "Partially Implantable Hearing Aid using Piezoelectric Ceramic Ossicular Vibrator", Abstract of Paper Presented at International Symposium on Electronic Implants in Otology and Conventional Hearing Aids, Walt Disney World Swan, Abstract #26, (Nov. 11–14, 1993).

OSSICULAR TRANSDUCER ATTACHMENT FOR AN IMPLANTABLE HEARING DEVICE

FIELD OF THE INVENTION

This invention relates to methods and apparatus for mounting transducers within a middle ear for use with an implantable hearing system.

BACKGROUND

In an implantable hearing aid system, transducers within the middle ear engage an auditory element and transduce from electrical signals into mechanical vibrations, and vice versa. Middle ear hearing aid systems are not as susceptible to mechanical feedback as other types of systems. Such implantable hearing aid systems are more comfortable for the patient than other types of hearing aids, such as those placed directly in the external auditory canal.

Transducers which contact an auditory element, such as one of the elements of the ossicular chain, require reliable disposition within the middle ear. Some disposition methods mechanically affix transducers to elements of the ossicular chain, e.g. mechanical fasteners, such as screws; metal hooks or bands; a constant force alone; or adhesives mount the transducer to an auditory element. Once implanted using such methods, transducers are not easily removed for adjustments and repairs.

SUMMARY OF THE INVENTION

An implantable hearing system transducer is easily mounted within a middle ear region with permanent magnets. In one embodiment, two half-ring magnets encompass the ossicular chain (e.g., preferably the long arm of the incus) to secure the transducer within the middle ear. The transducer can be mounted to one of the magnets prior to implantation. During surgery, the other magnet is permanently or temporarily tacked to the ossicular chain. Then, the magnet with the transducer is placed on the opposite side of the bone, such that it is magnetically attracted to the tacked magnet. If the transducer is not already mated to one magnet prior to surgery, it is attached to the magnet. The attraction between the magnets affixes the transducer to the bone. This invention is advantageous because permanent magnets are easy to use and can be easily removed for adjustments and repair. In further embodiments, the two permanent magnets are shaped, such that they lock around the ossicular chain.

In another embodiment, a "U"-shaped magnet and a transducer case encompass the ossicular chain (preferably the long arm of the incus) to secure a transducer within the middle ear. The transducer and a second magnet (any shape) are mounted within the transducer case. The magnet within the transducer case is magnetically attracted to the free magnet, locking the two magnets around the auditory element. Adhesives, or other fasteners suitable for the biological environment, are not required to affix the transducer to the magnet in this embodiment.

In yet another embodiment, an output transducer is magnetically-attached to the stapes within the middle ear region. The output transducer is encased in a transducer case, which lies in the same plane as the stirrup-shaped stapes. A multiple-prong magnet affixes the stapes to the transducer case. A magnet within the transducer case magnetically attracts the multiple-prong magnet, holding the transducer case against the stapes.

In yet another embodiment, a notch in a permanent magnet or a transducer binds the two together, affixing the transducer to the ossicular chain. In a further embodiment, the magnet, which attaches to the transducer, is wrapped around the transducer to keep it in place. In these embodiments, adhesives or magnets attaching the transducer case to the second permanent magnet are not required.

DETAILED DESCRIPTION

Figures 1A, 1B:
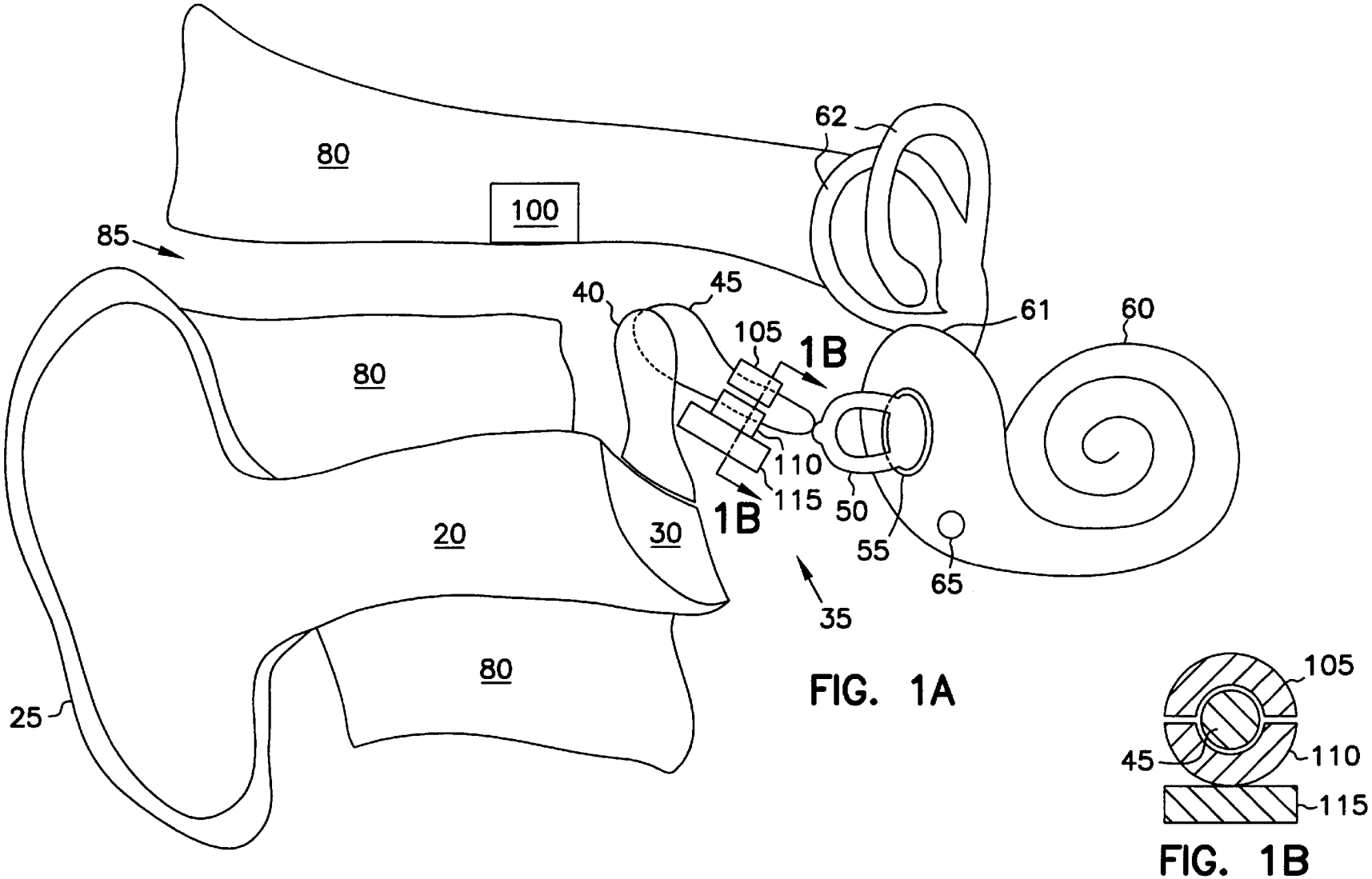
FIGS. 1A & 1B are schematic diagrams of one embodiment, in which two half-ring permanent magnets support a transducer case on the long arm of the incus.

The invention provides a transducer support, which is particularly advantageous when used in an implantable hearing system, such as a partial middle ear implantable (P-MEI) or total middle ear implantable (T-MEI) hearing aid system, or other hearing system such as a cochlear implant with middle ear vibration sensing. A P-MEI or T-MEI hearing aid system assists the human auditory system in converting acoustic energy contained within sound waves into electrochemical signals delivered to the brain and interpreted as sound. FIG. 1 A illustrates generally the use of the invention in a human auditory system. Sound waves are directed into an external auditory canal 20 by an outer ear (pinna) 25. The frequency characteristics of the sound waves are slightly modified by the resonant characteristics of the external auditory canal 20. These sound waves impinge upon the tympanic membrane (eardrum) 30, interposed at the terminus of the external auditory canal, between it and the tympanic cavity (middle ear) 35. Variations in the sound waves produce tympanic vibrations. The mechanical energy of the tympanic vibrations is communicated to the inner ear, comprising cochlea 60, vestibule 61, and semicircular canals 62, by a sequence of articulating bones located in the middle ear 35. This sequence of articulating bones is referred to generally as the ossicular chain. Thus, the tympanic membrane 30 and ossicular chain transform acoustic energy in the external auditory canal 20 to mechanical energy at the cochlea 60.

The ossicular chain includes three primary components: a malleus 40, an incus 45, and a stapes 50. The malleus 40 includes manubrium and head portions. The manubrium of the malleus 40 attaches to the tympanic membrane 30. The head of the malleus 40 articulates with one end of the incus 45. The incus 45 normally couples mechanical energy from the vibrating malleus 40 to the stapes 50. The stapes 50 includes a capitulum portion, comprising a head and a neck, connected to a footplate portion by means of a support crus comprising two crura. The stapes 50 is disposed in and against a membrane-covered opening on the cochlea 60. This membrane-covered opening between the cochlea 60 and middle ear 35 is referred to as the oval window 55. Oval window 55 is considered part of cochlea 60 in this patent application. The incus 45 articulates the capitulum of the stapes 50 to complete the mechanical transmission path.

Normally, prior to implantation of the invention, tympanic vibrations are mechanically conducted through the malleus 40, incus 45, and stapes 50, to the oval window 55. Vibrations at the oval window 55 are conducted into the fluid-filled cochlea 60. These mechanical vibrations generate fluidic motion, thereby transmitting hydraulic energy within the cochlea 60. Pressures generated in the cochlea 60 by fluidic motion are accommodated by a second membrane-covered opening on the cochlea 60. This second membrane-covered opening between the cochlea 60 and middle ear 35 is referred to as the round window 65. Round window 65 is considered part of cochlea 60 in this patent application. Receptor cells in the cochlea 60 translate the fluidic motion into neural impulses which are transmitted to the brain and perceived as sound. However, various disorders of the tympanic membrane 30, ossicular chain elements 40, 45, and 50, and/or the cochlea 60 can disrupt or impair normal hearing.

Hearing loss due to damage in the cochlea is referred to as sensorineural hearing loss. Hearing loss due to an inability to conduct mechanical vibrations through the middle ear is referred to as conductive hearing loss. Some patients have an ossicular chain lacking sufficient resiliency to transmit mechanical vibrations between the tympanic membrane 30 and the oval window 55. As a result, fluidic motion in the cochlea 60 is attenuated. Thus, receptor cells in the cochlea 60 do not receive adequate mechanical stimulation. Damaged elements of ossicular chain may also interrupt transmission of mechanical vibrations between the tympanic membrane 30 and the oval window 55.

Various techniques have been developed to remedy hearing loss resulting from conductive or sensorineural hearing disorder. For example, tympanoplasty is used to surgically reconstruct the tympanic membrane 30 and establish ossicular continuity from the tympanic membrane 30 to the oval window 55. Various passive mechanical prostheses and implantation techniques have been developed in connection with reconstructive surgery of the middle ear 35 for patients with damaged ossicles. Two basic forms of prosthesis are available: total ossicular replacement prostheses (TORP), which is connected between the tympanic membrane 30 and the oval window 55; and partial ossicular replacement prostheses (PORP), which is positioned between the tympanic membrane 30 and the stapes 50.

Various types of hearing aids have been developed to compensate for hearing disorders. A conventional "air conduction" hearing aid is sometimes used to overcome hearing loss due to sensorineural cochlear damage or mild conductive impediments to the ossicular chain. Conventional hearing aids utilize a microphone, which transduces sound into an electrical signal. Amplification circuitry amplifies the electrical signal. A speaker transduces the amplified electrical signal into acoustic energy transmitted to the tympanic membrane 30. However, some of the transmitted acoustic energy is typically detected by the microphone, resulting in a feedback signal which degrades sound quality. Conventional hearing aids also often suffer from a significant amount of signal distortion.

Implantable hearing aid systems have also been developed, utilizing various approaches to compensate for hearing disorders. For example, cochlear implant techniques implement an inner ear hearing aid system. Cochlear implants electrically stimulate auditory nerve fibers within the cochlea 60. A typical cochlear implant system includes an external microphone, an external signal processor, and an external transmitter, as well as an implanted receiver and an implanted single channel or multichannel probe. A single channel probe has one electrode. A multichannel probe has an array of several electrodes. In the more advanced multichannel cochlear implant, a signal processor converts speech signals transduced by the microphone into a series of sequential electrical pulses of different frequency bands within a speech frequency spectrum. Electrical pulses corresponding to low frequency sounds are delivered to electrodes that are more apical in the cochlea 60. Electrical pulses corresponding to high frequency sounds are delivered to electrodes that are more basal in the cochlea 60. The nerve fibers stimulated by the electrodes of the cochlear implant probe transmit neural impulses to the brain, where these neural impulses are interpreted as sound.

Other inner ear hearing aid systems have been developed to aid patients without an intact tympanic membrane 30, upon which "air conduction" hearing aids depend. For example, temporal bone conduction hearing aid systems produce mechanical vibrations that are coupled to the cochlea 60 via a temporal bone in the skull. In such temporal bone conduction hearing aid systems, a vibrating element can be implemented percutaneously or subcutaneously.

A particularly interesting class of hearing aid systems includes those which are configured for disposition principally within the middle ear 35 space. In middle ear implantable (MEI) hearing aids, an electrical-to-mechanical output transducer couples mechanical vibrations to the ossicular chain, which is optionally interrupted to allow coupling of the mechanical vibrations to the ossicular chain. Both electromagnetic and piezoelectric output transducers have been used to effect the mechanical vibrations upon the ossicular chain.

One example of a partial middle ear implantable (P-MEI) hearing aid system having an electromagnetic output transducer comprises: an external microphone transducing sound into electrical signals; external amplification and modulation circuitry; and an external radio frequency (RF) transmitter for transdermal RF communication of an electrical signal. An implanted receiver detects and rectifies the transmitted signal, driving an implanted coil in constant current mode. A resulting magnetic field from the implanted drive coil vibrates an implanted magnet that is permanently affixed only to the incus 45. Such electromagnetic output transducers have relatively high power consumption, which limits their usefulness in total middle ear implantable (T-MEI) hearing aid systems.

A piezoelectric output transducer is also capable of effecting mechanical vibrations to the ossicular chain. An example of such a device is disclosed in U.S. Pat. No. 4,729,366, issued to D. W. Schaefer on Mar. 8, 1988. In the '366 patent, a mechanical-to-electrical piezoelectric input transducer is associated with the malleus 40, transducing mechanical energy into an electrical signal, which is amplified and further processed. A resulting electrical signal is provided to an electrical-to-mechanical piezoelectric output transducer that generates a mechanical vibration coupled to an element of the ossicular chain or to the oval window 55 or round window 65. In the '366 patent, the ossicular chain is interrupted by removal of the incus 45. Removal of the incus 45 prevents the mechanical vibrations delivered by the piezoelectric output transducer from mechanically feeding back to the piezoelectric input transducer.

Piezoelectric output transducers have several advantages over electromagnetic output transducers. The smaller size or volume of the piezoelectric output transducer advantageously eases implantation into the middle ear 35. The lower power consumption of the piezoelectric output transducer is particularly attractive for T-MEI hearing aid systems, which include a limited longevity implanted battery as a power source.

For implantation of hearing aid components, an access hole 85 is created in a region of the temporal bone known as the mastoid 80. An incision is made in the skin covering the mastoid 80, and an underlying access hole 85 is created through the mastoid 80 allowing external access to the middle ear 35. The access hole 85 is located approximately posterior and superior to the external auditory canal 20. The transducers are implanted through the access hole 35, along with magnets 105 and 110, which couple the transducers to the auditory element 40, 45, 50. The electronics unit 100 of the IHA is separately implanted. This eases implantation and repair or adjustment to the electronics unit 100 of the IHA. Repairs, such as changing a battery in the electronics unit 100 of the IHA, are easily made without removing the transducers.

FIG. 1A illustrates ossicular chain elements within a middle ear region 35, in which one embodiment of the invention supports a transducer on one of the ossicular chain elements, the long arm of the incus 45, but the transducer can also be attached at other locations than that shown. In general, for illustration purposes, transducer placement is shown on a particular ossicle 40, 45, 50, but may have several potential placements along the ossicular chain. A first, half ring-shaped permanent magnet 105 is permanently or temporarily tacked to the long arm of the incus 45 during surgery. It is preferable to permanently tack the magnet 105 to the long arm of the incus 45, with a biocompatible adhesive, so as to add further stability to the ossicular transducer attachment. Biocompatible adhesives comprise, among others, ultraviolet-cured epoxies, two-part epoxies, silicone adhesives, dental adhesives, acrylic methacrylate, and urethane methacrylate. A conformable material can be used to ensure a customized fit between the ossicular chain 40, 45, 50, and the permanent magnets 105 and 110.

A transducer case 115 is coupled to a second, half ring-shaped permanent magnet 110. The transducer is hermetically-sealed within the transducer case 115, which comprises a biocompatible material, such as titanium or stainless steel. Then, the second permanent magnet 110, coupled with the transducer case 115, is placed opposite the first permanent magnet 105, such that the two magnets 105 and 110 encircle the long arm of the incus 45, as shown in FIG. 1B. However, the transducer does not always need to be encased in a transducer case 115. For example, a transducer case 115 is not needed when a coated polyvinylidene fluoride transducer is used. Furthermore, it is not necessary that the two permanent magnets 105 and 110 actually contact one another. It is sufficient for the two permanent magnets 105 and 110 to act on each other with a sufficient magnetic force to secure the transducer case 115 to the long arm of the incus 45. Since it is required that there be a close fit between the magnet 105, 110 and the ossicular chain element 40, 45, 50, it is preferable that the two permanent magnets 105 and 110 do not completely touch, so as to prevent movement once they are magnetically-coupled together and to ensure long-term compressive contact between the ossicular chain element 40, 45, 50, and the permanent magnets 105 and 110.

Figure 1C:
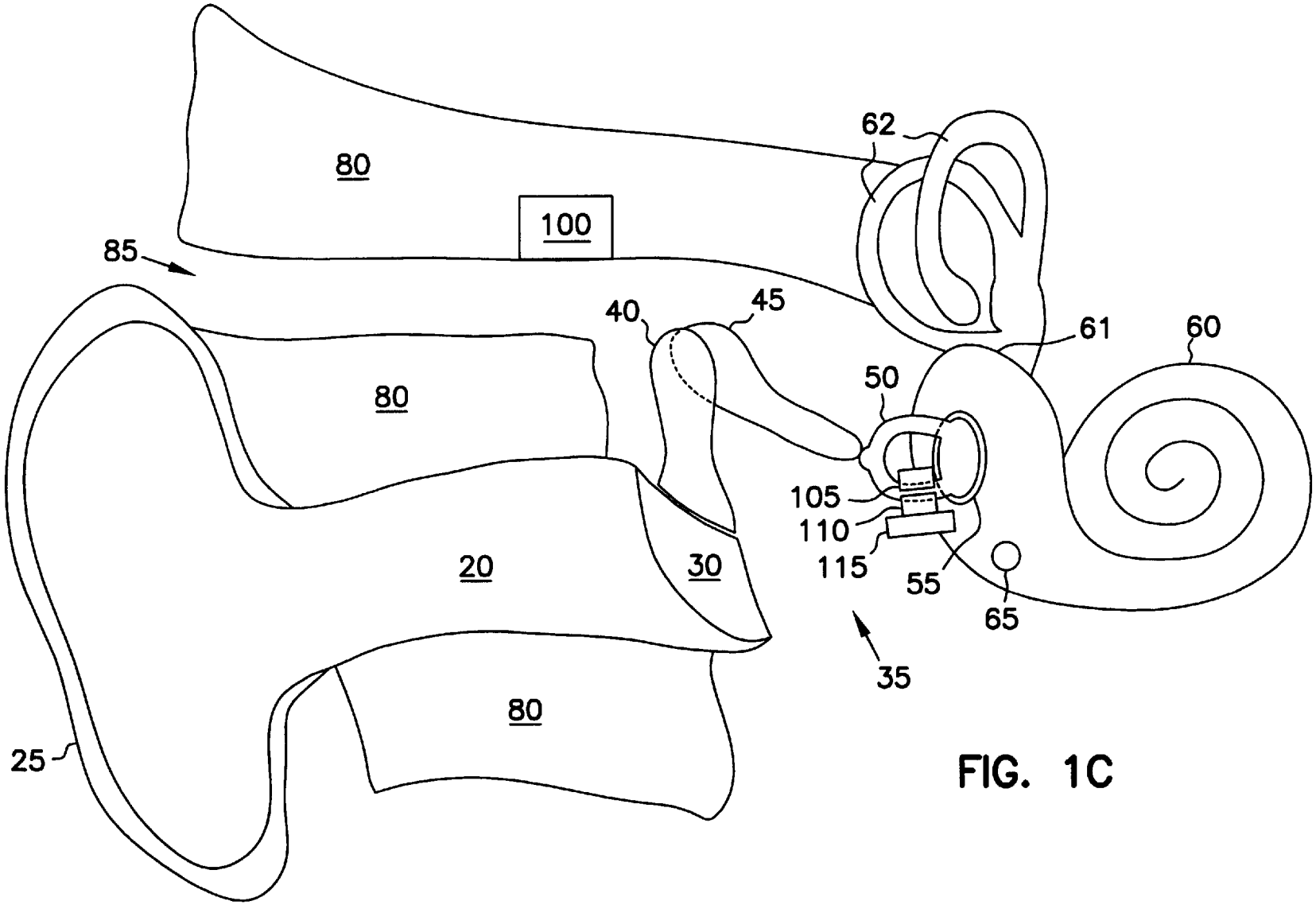
FIG. 1C is a schematic diagram of another embodiment, in which two half-ring permanent magnets support a transducer case on the stapes.
Figure 1D:
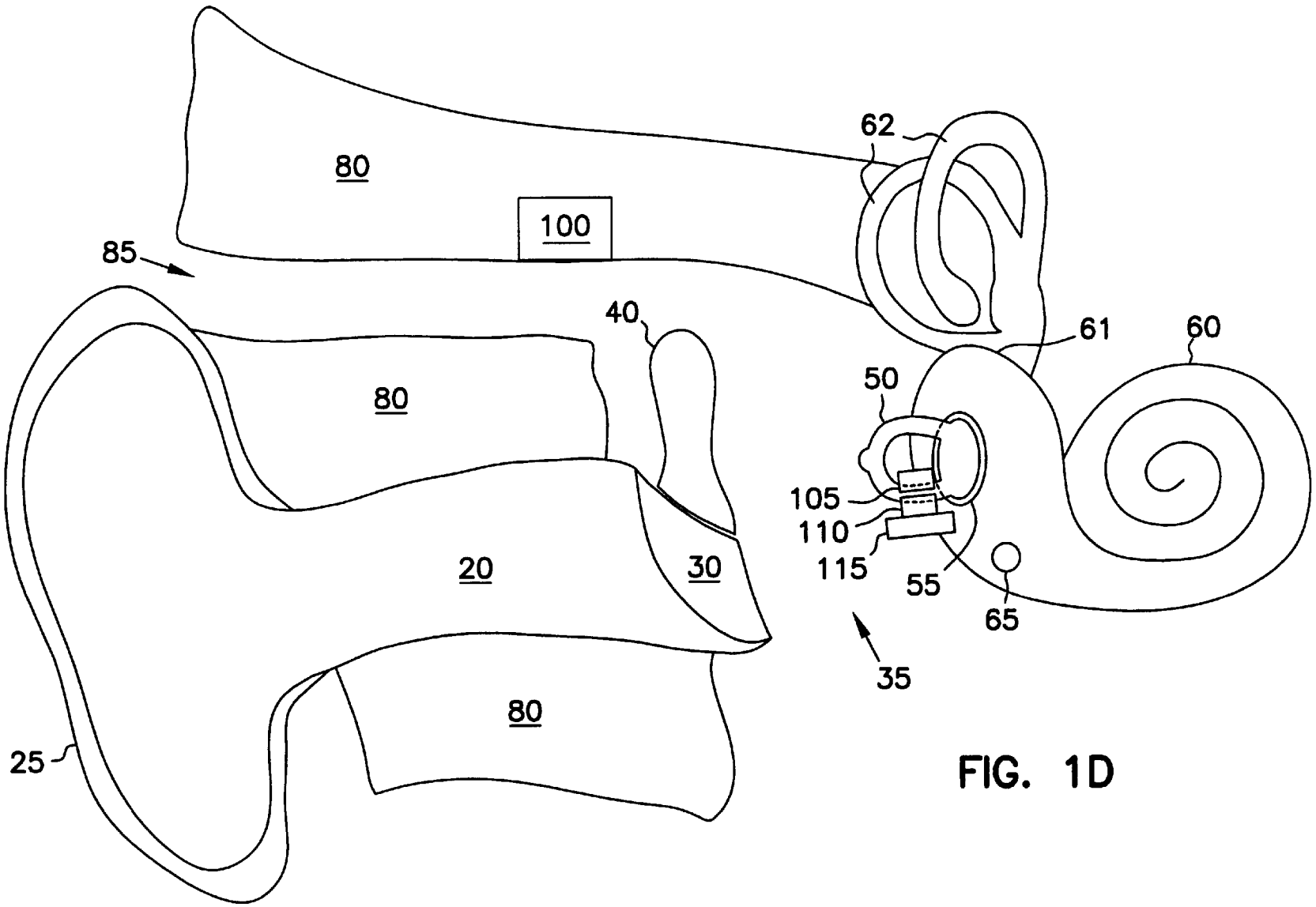
FIG. 1D is a schematic diagram of a further embodiment of the invention shown in FIG. 1C, in which the incus is removed.
Figure 1E:
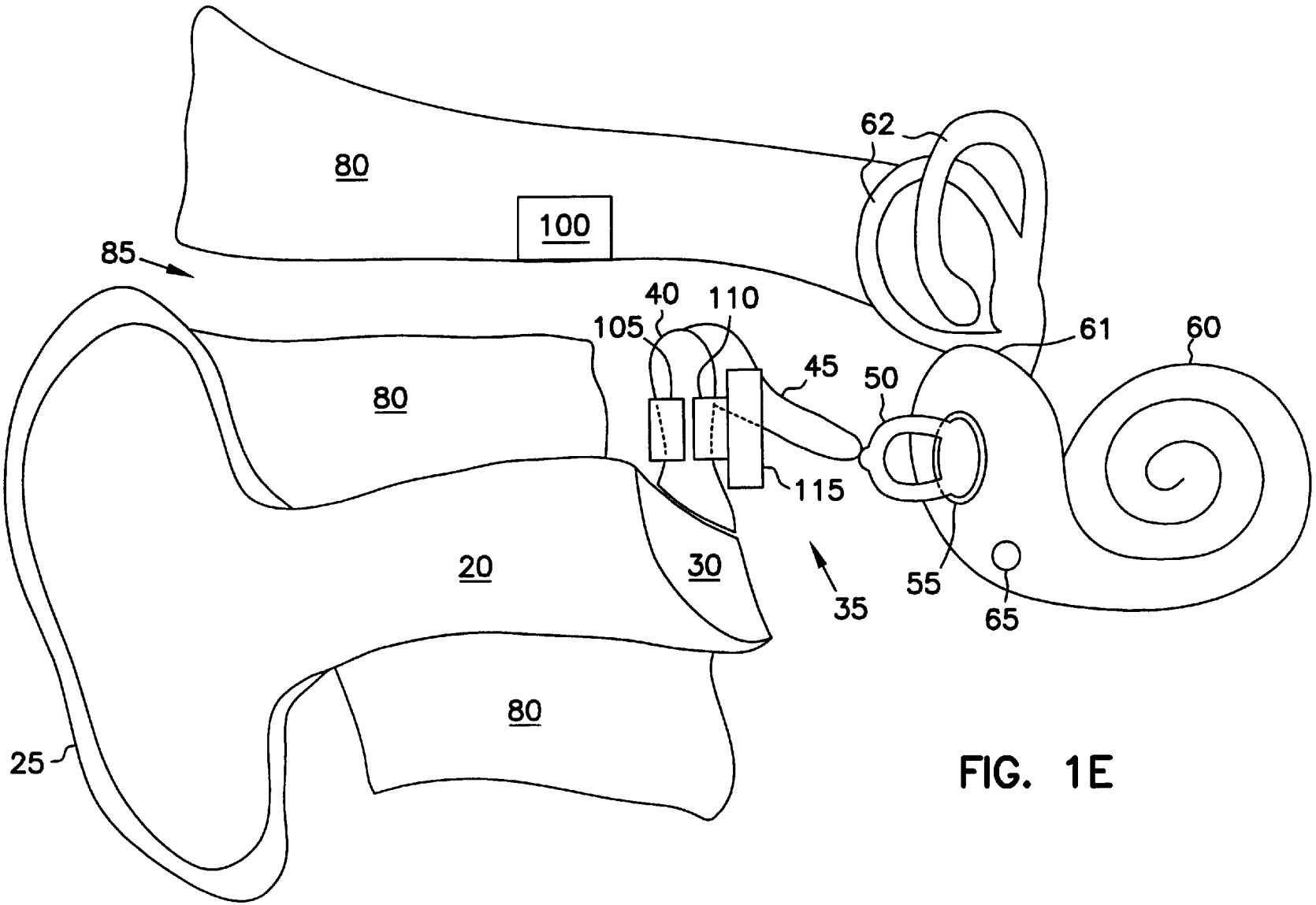
FIG. 1E is a schematic diagram of another embodiment, in which two half-ring permanent magnets support a transducer case on the malleus.
Figure 1F:
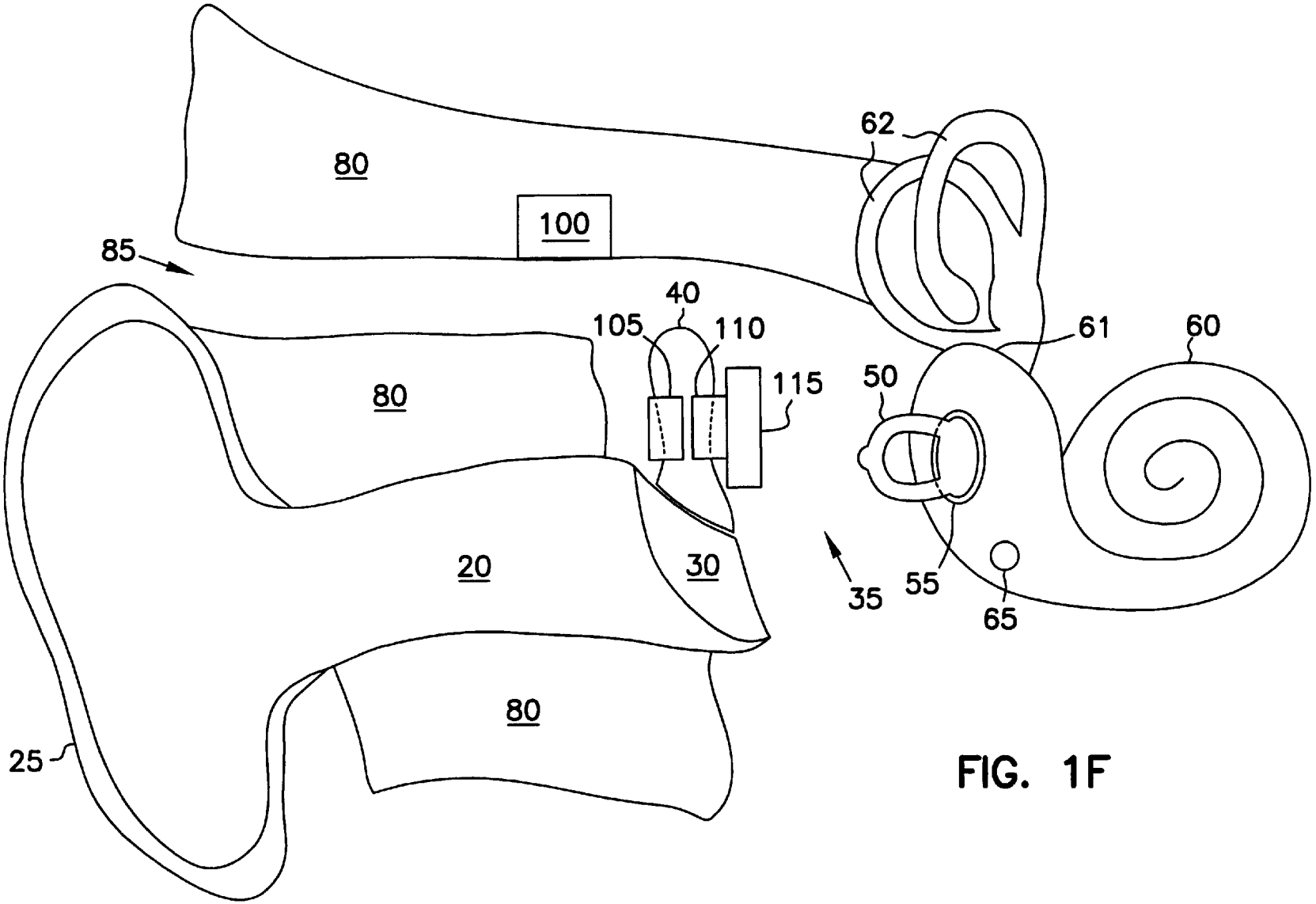
FIG. 1F is a schematic diagram of a further embodiment of the invention shown in FIG. 1E, in which the incus is removed.
Figure 1H:
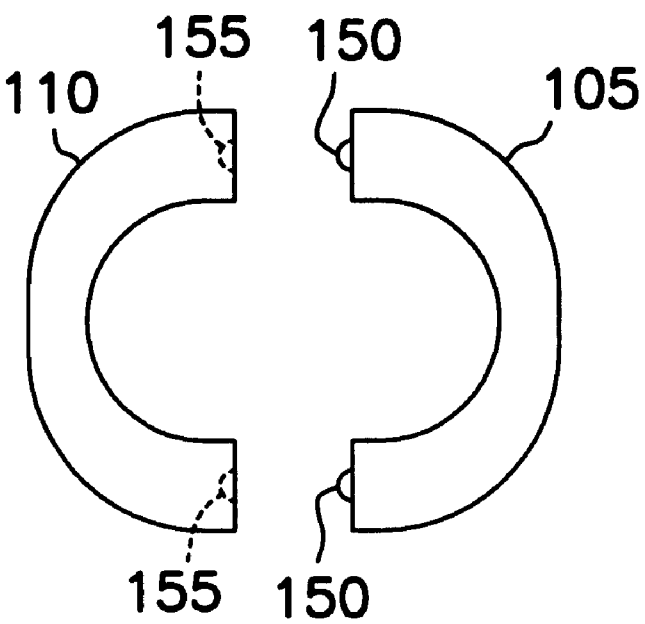
FIG. 1H is a side view of a further embodiment of the permanent magnets shown in FIG. 1B.
Figure 1G:
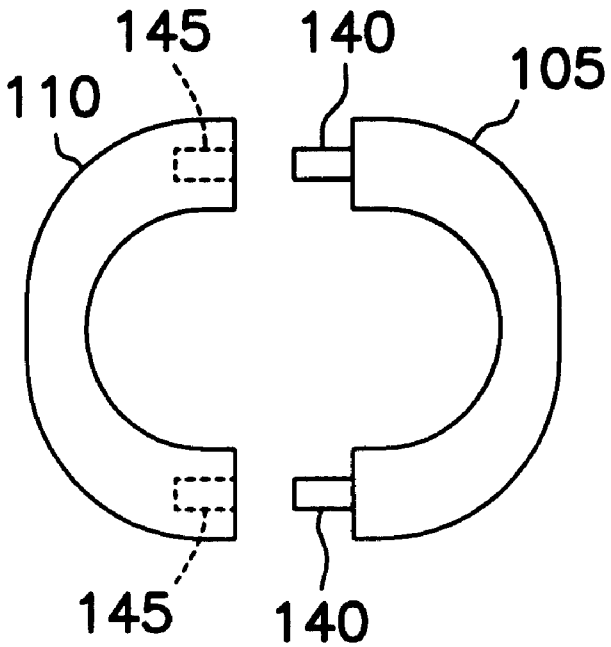
FIG. 1G is a side view of a further embodiment of t he permanent magnets shown in FIG. 1A.

In a further embodiment, as shown in FIG. 1C, the transducer case 115 and second permanent magnet 110 are magnetically-coupled to the first permanent magnet 105, encircling the crura of the stapes 50 member of the ossicular chain. In yet a further embodiment, as shown in FIG. 1D, the incus 45 is removed to decrease mechanical feedback between the malleus 40 and the stapes 50. It is not necessary that the two permanent magnets 105 and 110 actually contact one another. It is sufficient for the two permanent magnets 105 and 110 to act on each other with a sufficient magnetic force to secure the transducer case 115 to the stapes 50. Since it is required that there be a close fit between the magnet 105, 110 and the ossicular chain element 40, 45, 50, it is preferable that the two permanent magnets 105 and 110 do not completely touch, so as to prevent movement once they are magnetically-coupled together and to ensure long-term compressive contact between the ossicular chain element 40, 45, 50, and the permanent magnets 105 and 110.

In yet a further embodiment, as shown in FIG. 1 E, the transducer case 115 and second permanent magnet 110 are magnetically-coupled to the first permanent magnet 105, encircling the neck portion of the malleus 40 member of the ossicular chain. In an even further embodiment, as shown in FIG. 1F, the incus 45 is removed to decrease mechanical feedback between the malleus 40 and the stapes 50. It is not necessary that the two permanent magnets 105 and 110 actually contact one another. It is sufficient for the two permanent magnets 105 and 110 to act on each other with a sufficient magnetic force to secure the transducer case 115 to the neck portion of the malleus 40. Since it is required that there be a close fit between the magnet 105, 110 and the ossicular chain element 40, 45, 50, it is preferable that the two permanent magnets 105 and 110 do not completely touch, so as to prevent movement once they are magnetically-coupled together and to ensure long-term compressive contact between the ossicular chain element 40, 45, 50, and the permanent magnets 105 and 110.

In further embodiments of the invention, two locking permanent magnets 105 and 110 are used to further maintain the force of attraction and position between the two magnets l05 and 110 encircling the ossicular chain. For example, as shown in FIG. 1 G, tubes 140 and respective slots 145 on mating ends of opposite magnets 105, 110 interlock around the ossicular chain. In an alternate embodiment, rounded knobs 150 and respective slots 155 on mating ends of opposite magnets 105, 110 interlock around the ossicular chain. In these embodiments, the magnets 105 and 110 also need not fully lock, so as to add further stability to the attachment.

Figures 2A, 2B:
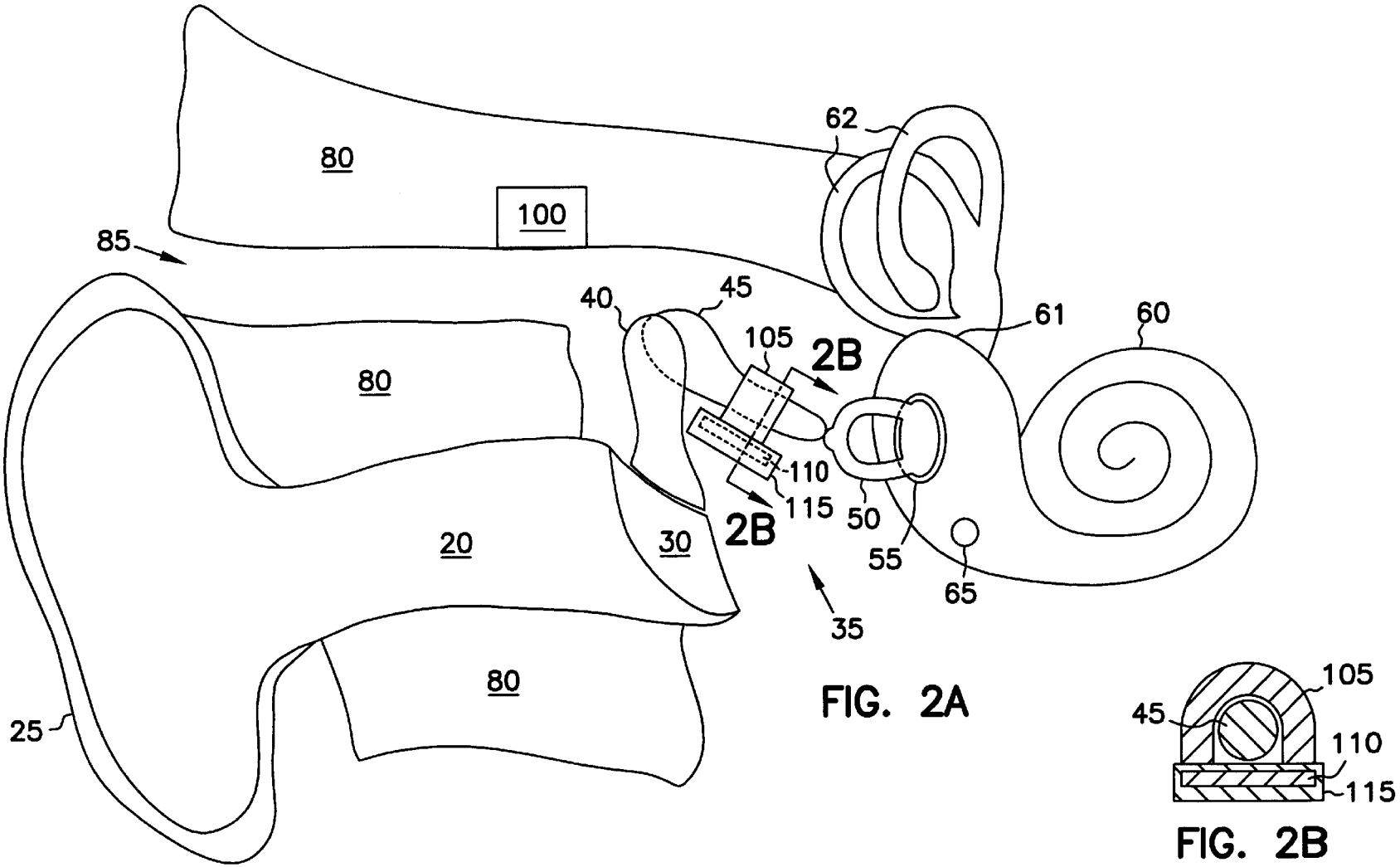
FIGS. 2A & 2B are schematic diagrams of another embodiment, in which a "U"-shaped magnet supports a transducer case, containing a second magnet, on the long arm of the incus.

In a second embodiment of the invention, as shown in FIGS. 2A and 2B, a transducer is coupled to the long arm of the incus 45 within the middle ear region 35. A first, "U"-shaped permanent magnet 105 is permanently or temporarily tacked to the long arm of the incus 45 during implantation surgery. It is preferable to permanently tack the magnet 105 to the long arm of the incus 45, with a biocompatible adhesive, so as to add further stability to the ossicular transducer attachment. A conformable material can be used to ensure a customized fit between the ossicular chain 40, 45, 50, and the permanent magnets 105 and 110.

A second permanent magnet 110 is hermetically-sealed in a transducer case 115 along with a transducer (not shown). The transducer case 115 comprises a biocompatible material, such as titanium or stainless steel. The shape of the second permanent magnet 110 is not critical to the invention. The primary concern, however, is that portions of the second permanent magnet 110 are magnetically-disposed opposite portions of the "U"-shaped first permanent magnet 105 to provide sufficient magnetic force to hold the two permanent magnets 105 and 110 together. Then, the transducer case 115 is placed opposite the free ends of the first permanent magnet 105, such that the two magnets 105 and 110 are magnetically-coupled around the long arm of the incus 45, as shown in FIG. 2B. In another embodiment, the second permanent magnet 110 can comprise a ferromagnetic inner lining for the transducer case 115, instead of being shaped as a block magnet. It is not necessary that the first permanent magnet 105 actually contacts the transducer case 115, which contains the second permanent magnet 110. It is sufficient for the two permanent magnets 105 and 110 to act on each other with a sufficient magnetic force to secure the transducer case 115 to the long arm of the incus 45. Since it is required that there be a close fit between the magnet 105, 110 and the ossicular chain element 40, 45, 50, it is preferable that the two permanent magnets 105 and 110 do not completely touch, so as to prevent movement once they are magnetically-coupled together and to ensure long-term compressive contact between the ossicular chain element 40, 45, 50, and the permanent magnets 105 and 110.

Figure 2C:
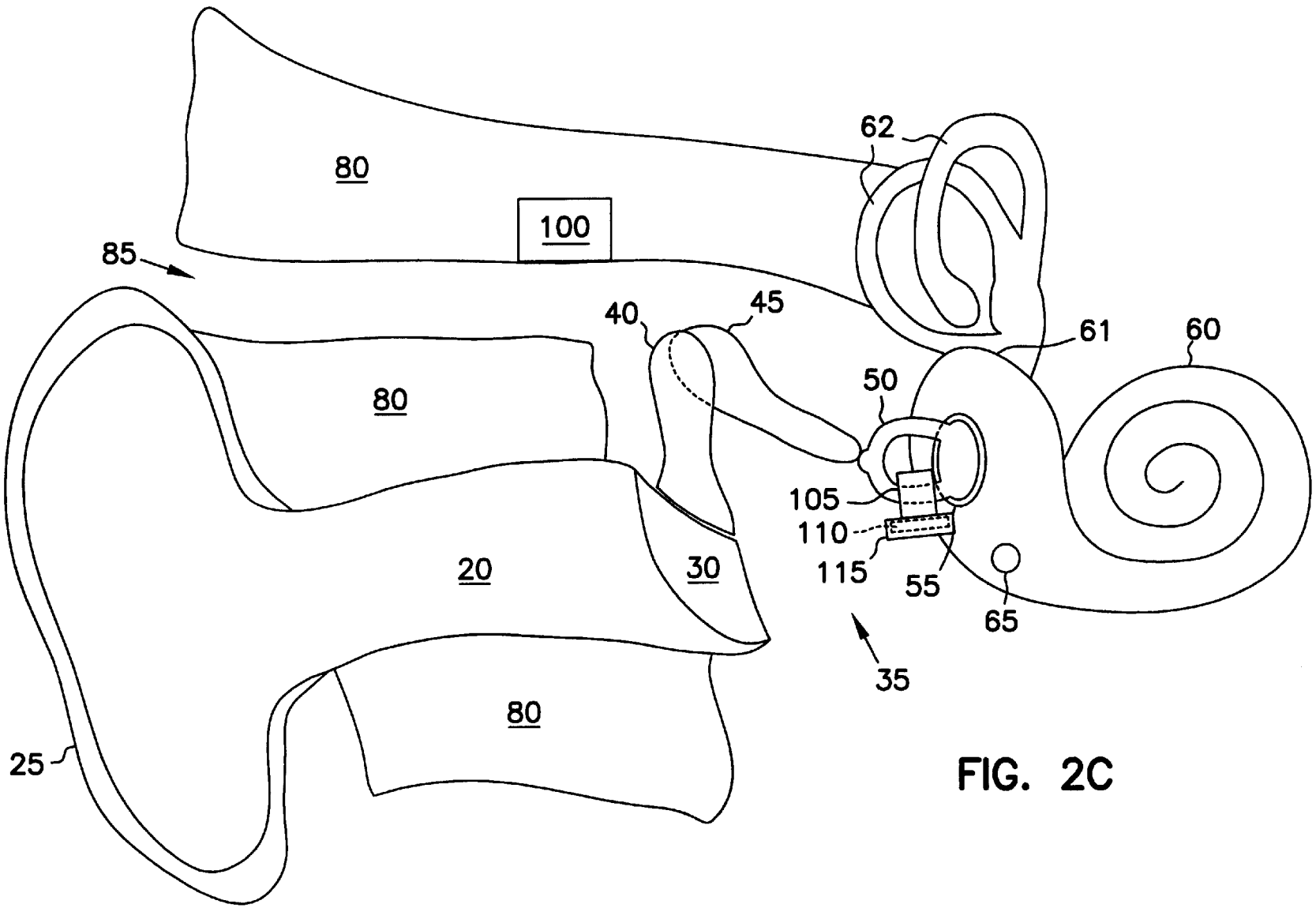
FIG. 2C is a schematic diagram of another embodiment, in which a "U"-shaped magnet supports a transducer case, containing a second magnet, on the stapes.
Figure 2D:
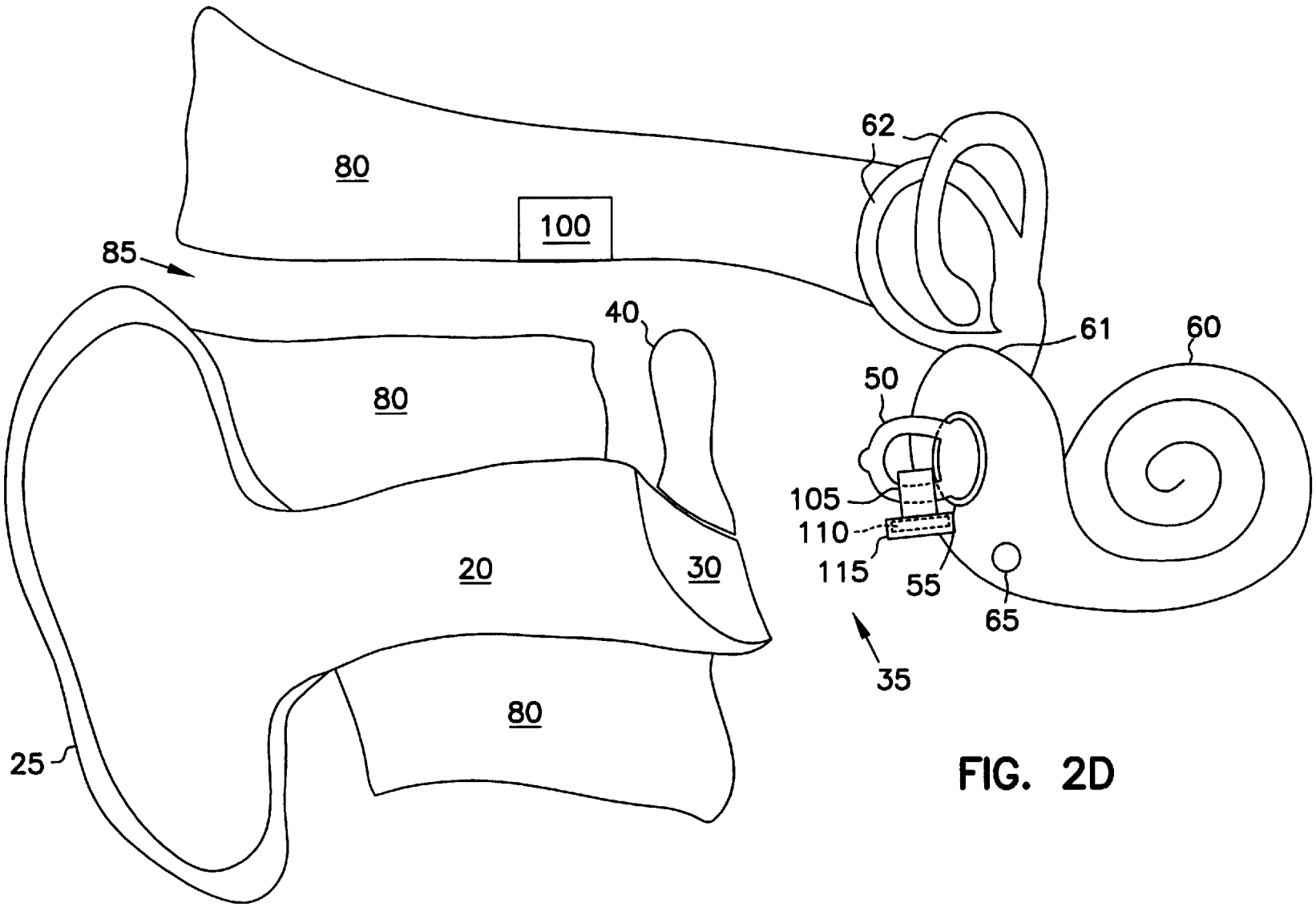
FIG. 2D is a schematic diagram of a further embodiment of the invention shown in FIG. 2C, in which the incus is removed.

In a further embodiment, as shown in FIG. 2C, the transducer case 115 containing the second permanent magnet 110 is magnetically-coupled to the first permanent magnet 105, encircling the crura of the stapes 50 member of the ossicular chain. In yet a further embodiment, as shown in FIG. 2D, the incus 45 is removed to decrease mechanical feedback between the malleus 40 and the stapes 50. It is not necessary that the first permanent magnet 105 actually contacts the transducer case 115. It is sufficient for the two permanent magnets 105 and 110 to act on each other with a sufficient magnetic force to secure the transducer case 115 to the crura of the stapes 50. Since it is required that there be a close fit between the magnet 105, 110 and the ossicular chain element 40, 45, 50, it is preferable that the first permanent magnet 105 and the transducer case 115 do not completely touch, so as to prevent movement once they are magnetically-coupled together.

Figure 2E:
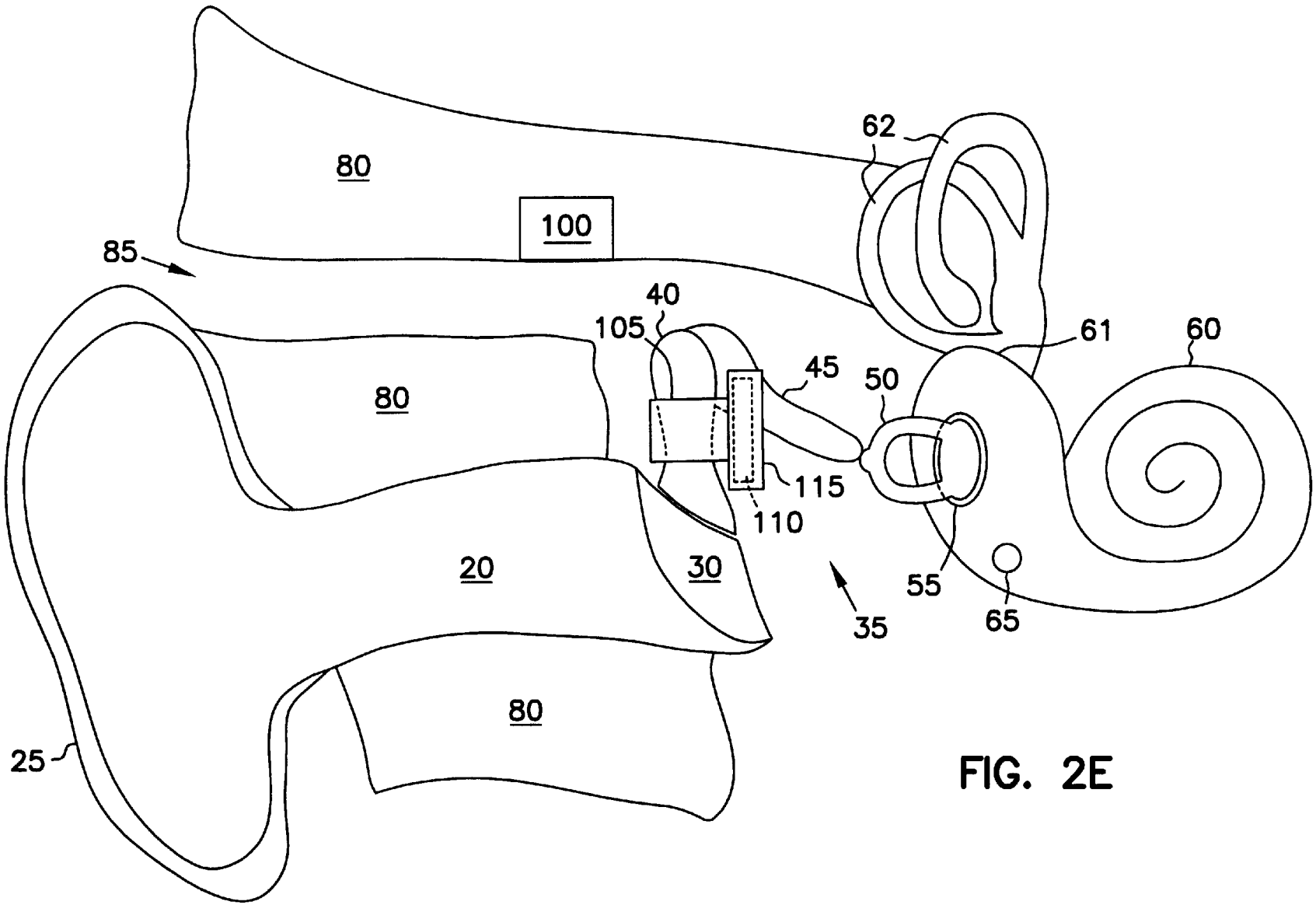
FIG. 2E is a schematic diagram of another embodiment, in which a "U"-shaped magnet supports a transducer case, containing a second magnet, on the malleus.
Figure 2F:
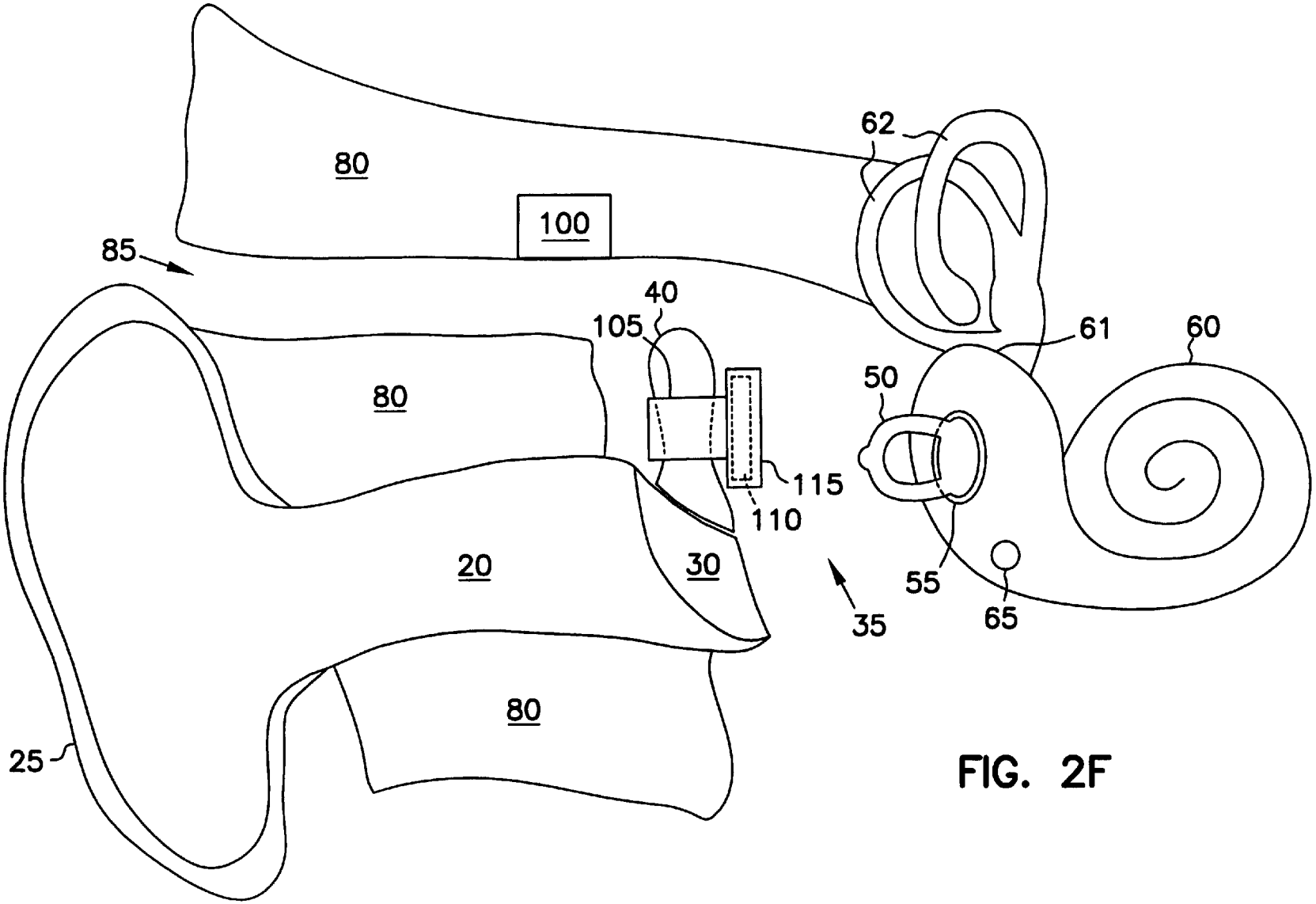
FIG. 2F is a schematic diagram of a further embodiment of the invention shown in FIG. 2E, in which the incus is removed.

In yet a further embodiment, as shown in FIG. 2E, the transducer case 115 containing the second permanent magnet 110 is magnetically-coupled to the first permanent magnet 105, encircling the neck portion of the malleus 40 member of the ossicular chain. In yet a further embodiment, as shown in FIG. 2F, the incus 45 is removed to decrease feedback between the malleus 40 and the stapes 50. It is not necessary that the first permanent magnet 105 actually contacts the transducer case 115. It is sufficient for the two permanent magnets 105 and 110 to act on each other with a sufficient magnetic force to secure the transducer case 115 to the neck portion of the malleus 40. Since it is required that there be a close fit between the magnet 105, 110 and the ossicular chain element 40, 45, 50, it is preferable that the two permanent magnets 105 and 110 do not completely touch, so as to prevent movement once they are magnetically-coupled together and to ensure long-term compressive contact between the ossicular chain element 40, 45, 50, and the permanent magnets 105 and 110.

Figures 3A, 3B, 3C:
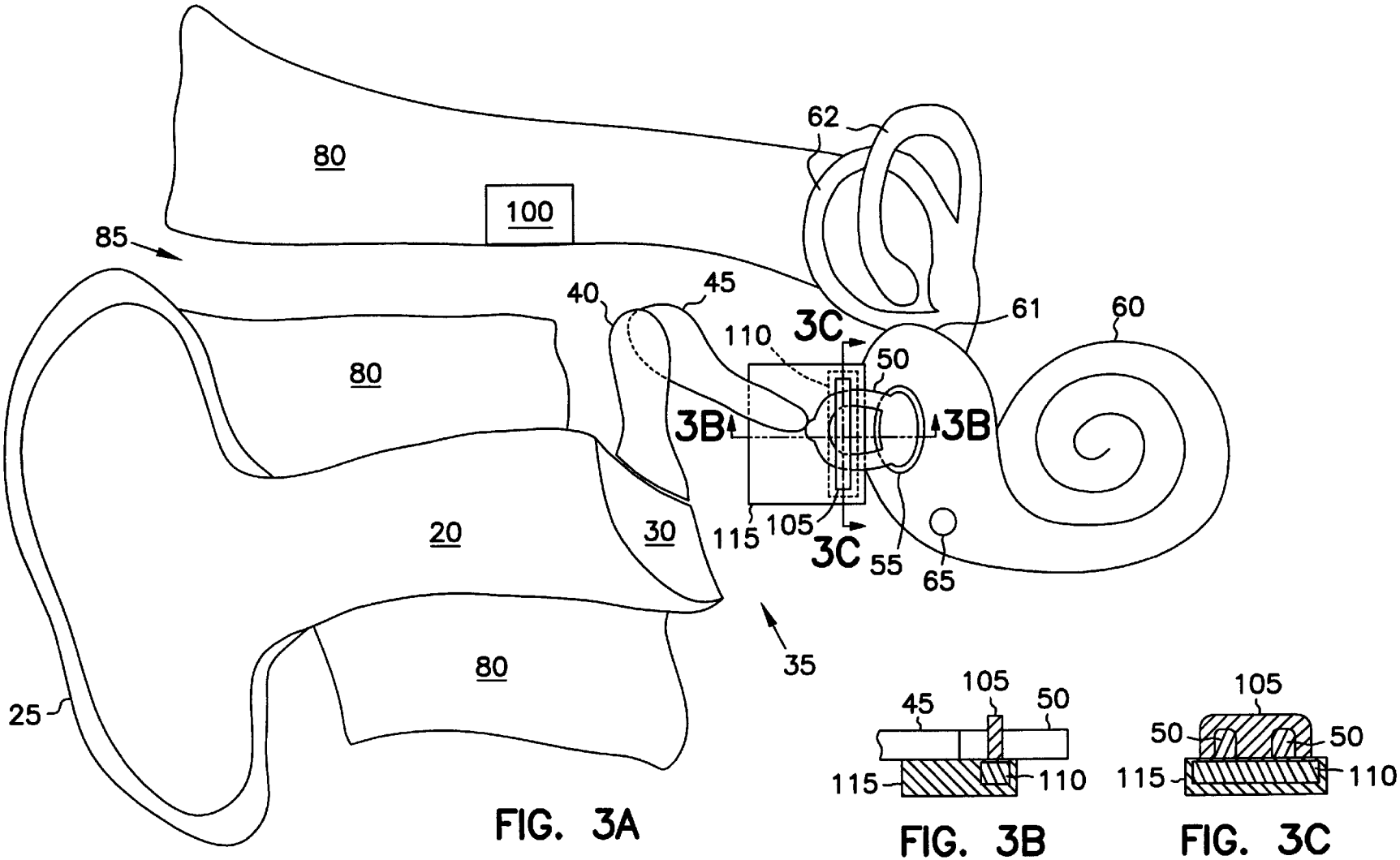
FIG. 3A is a schematic diagram of another embodiment, in which a multiple-prong magnet supports a transducer case, containing a second magnet, on the stapes.
FIG. 3B is a side view of the invention shown in FIG. 3A, taken along the plane B—B.
FIG. 3C is a side view of the invention shown in FIG. 3A, taken along the plane A—A.

In another embodiment, as shown in FIGS. 3A, 3B, and 3C, a transducer case 115 is mounted to the crura of the stapes 50. The first permanent magnet 115 comprises a multiple-prong permanent magnet 115, preferably having three prongs. The transducer case 115 contains a transducer (not shown) and a second permanent magnet 110. The shape of the second permanent magnet 110 is not critical to the invention. The primary concern, however, is that portions of the second permanent magnet 110 are magnetically-disposed opposite the multiple prongs of the first permanent magnet 105. Then, the transducer case 115 is placed opposite the multiple prongs of the first permanent magnet 105, such that the two magnets 105 and 110 are magnetically-coupled around the crura of the stapes 50, as shown in FIG. 3A. The transducer case 115 lies in a parallel plane with the stapes 50 and can be disposed on either side of the stapes 50. In another embodiment, the second permanent magnet 110 can comprise a ferromagnetic inner lining for the transducer case 115, instead of being shaped as a block magnet.

Figures 4A, 4B:
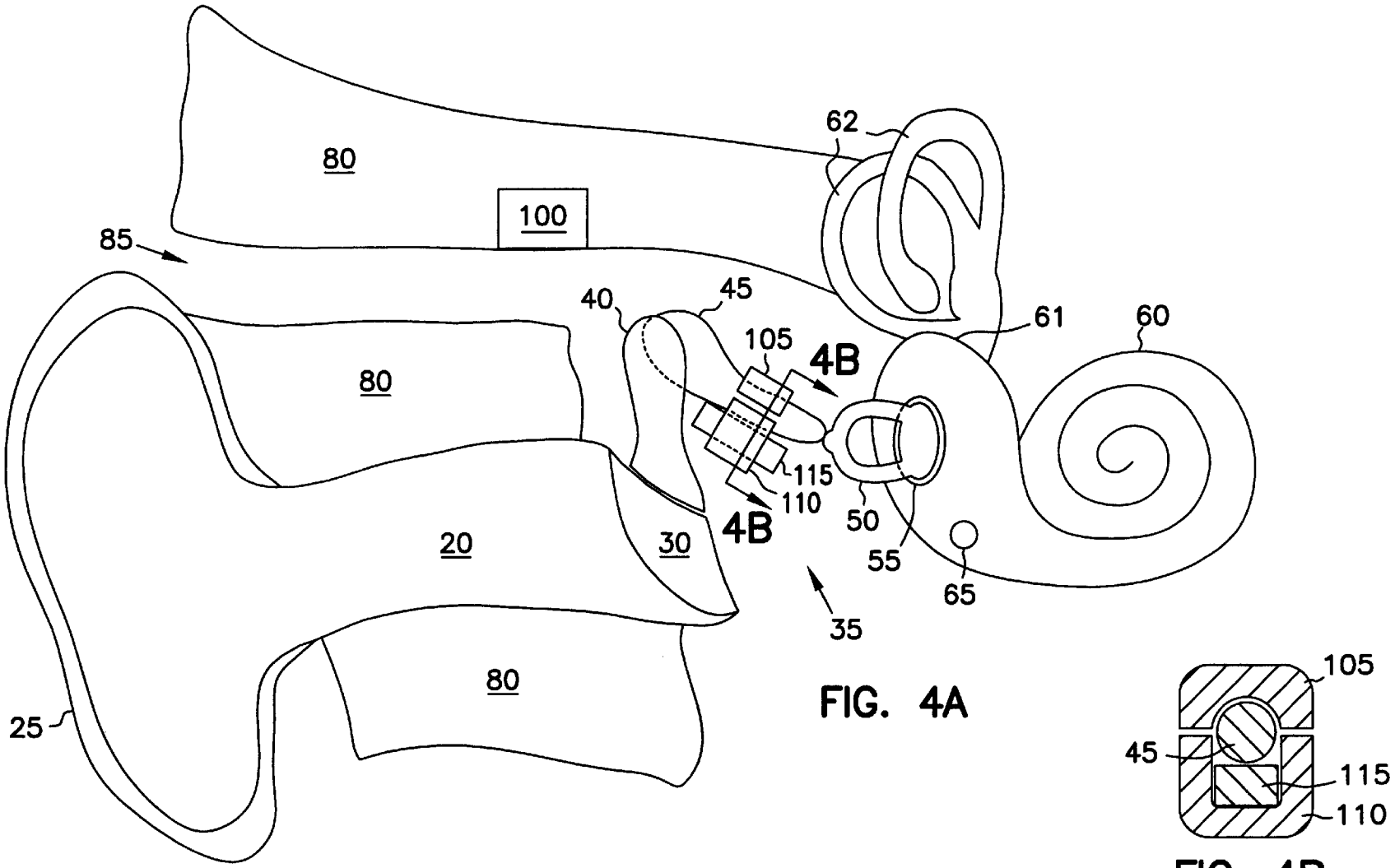
FIGS. 4A & 4B are schematic diagrams of another embodiment, in which the transducer case is affixed between two permanent magnets and the long arm of the incus.

In another embodiment, as shown in FIGS. 4A and 4B, a the second permanent magnet 110 is wrapped around a transducer case 115. The transducer case 115 houses a transducer (not shown). The second permanent magnet 110 is magnetically-coupled to a first permanent magnet 105, encircling the long arm of the incus 45. In this embodiment, the transducer case 115 is attached to the second permanent magnet 110 prior to implantation without using adhesives or requiring that the second permanent magnet 110 be placed within the transducer case 115. This enables joining of the second permanent magnet 110 and the transducer case 115 under more ideal conditions than those existing during the implantation procedure. A notch is placed on either the second permanent magnet 110 or the transducer case 115, which fits into the other piece, to prevent separation.

It is not necessary that the two permanent magnets 105 and 110 actually contact one another. It is sufficient for the two permanent magnets 105 and 110 to act on each other with a sufficient magnetic force to secure the transducer case 115 to the long arm of the incus 45, without the notch becoming uncoupled. Since it is required that there be a close fit between the magnet 105, 110 and the ossicular chain element 40, 45, 50, it is preferable that the two permanent magnets 105 and 110 do not completely touch, so as to prevent movement once they are magnetically-coupled together and to ensure long-term compressive contact between the ossicular chain element 40, 45, 50, and the permanent magnets 105 and 110.

Figure 4C:
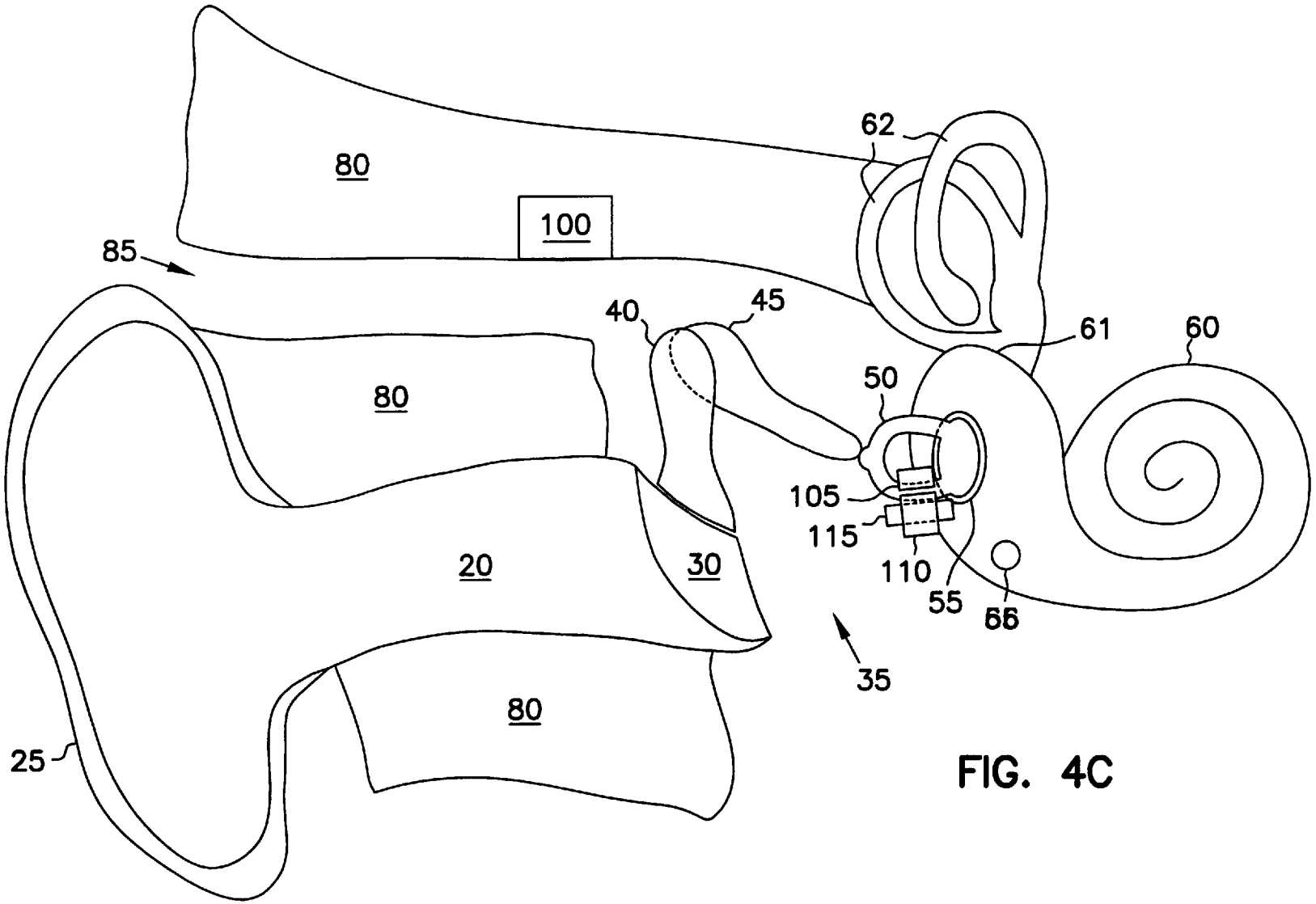
FIG. 4C is a schematic diagram of another embodiment, in which the transducer case is affixed between two permanent magnets and the stapes.
Figure 4D:
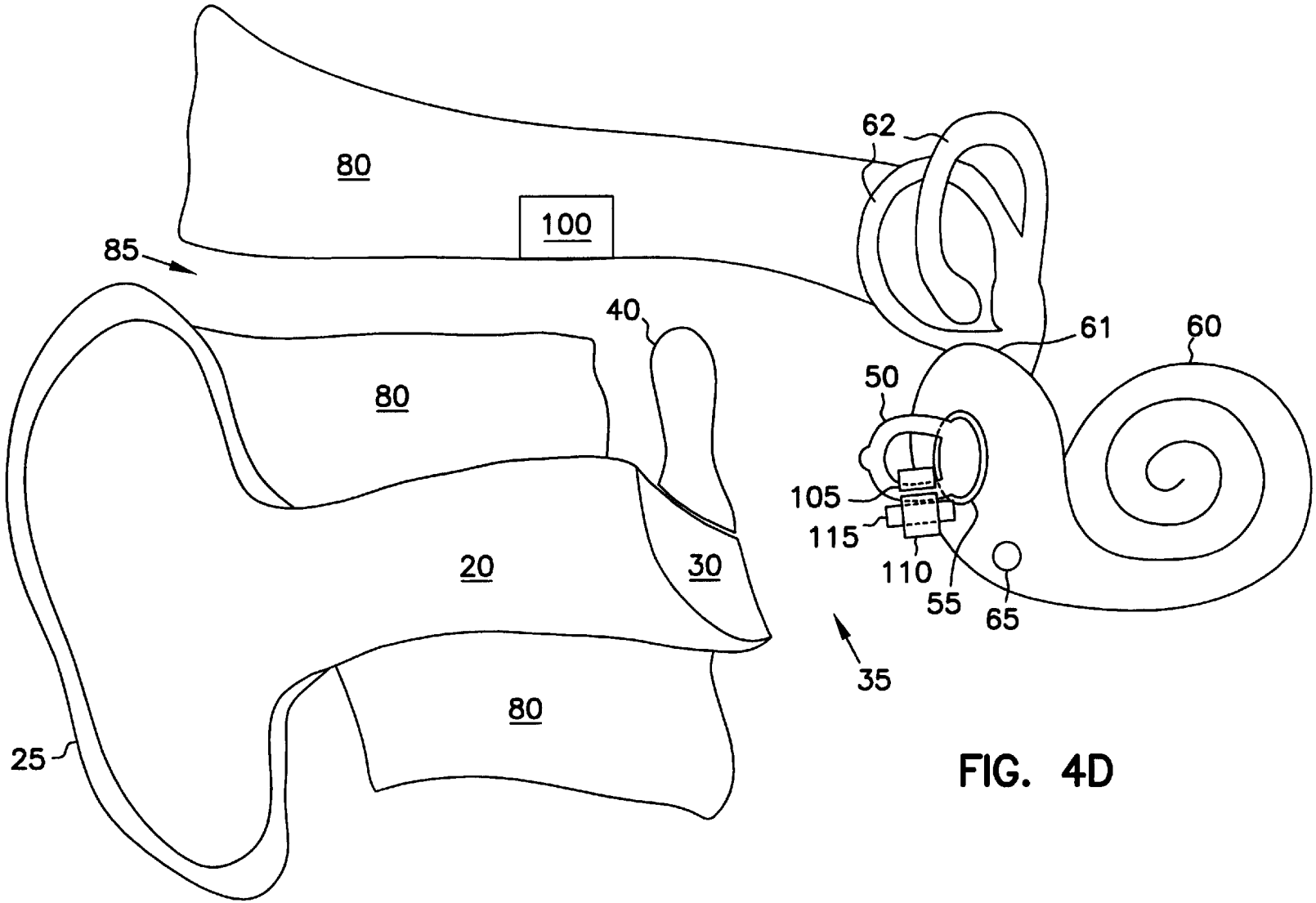
FIG. 4D is a schematic diagram of a further embodiment of the invention shown in FIG. 4C, in which the incus is removed.

In a further embodiment, as shown in FIG. 4C, the two permanent magnets 105 and 110 encircle the crura of the stapes 50. In yet a further embodiment, as shown in FIG. 4D, the incus 45 is removed to prevent mechanical feedback between the malleus 40 and the stapes 50. It is not necessary that the two permanent magnets 105 and 110 actually contact one another. It is sufficient for the two permanent magnets 105 and 110 to act on each other with a sufficient magnetic force to secure the transducer case 115 to the crura of the stapes 50. Since it is required that there be a close fit between the magnet 105, 110 and the ossicular chain element 40, 45, 50, it is preferable that the two permanent magnets 105 and 110 do not completely touch, so as to prevent movement once they are magnetically-coupled together and to ensure long-term compressive contact between the ossicular chain element 40, 45, 50, and the permanent magnets 105 and 110.

Figure 4E:
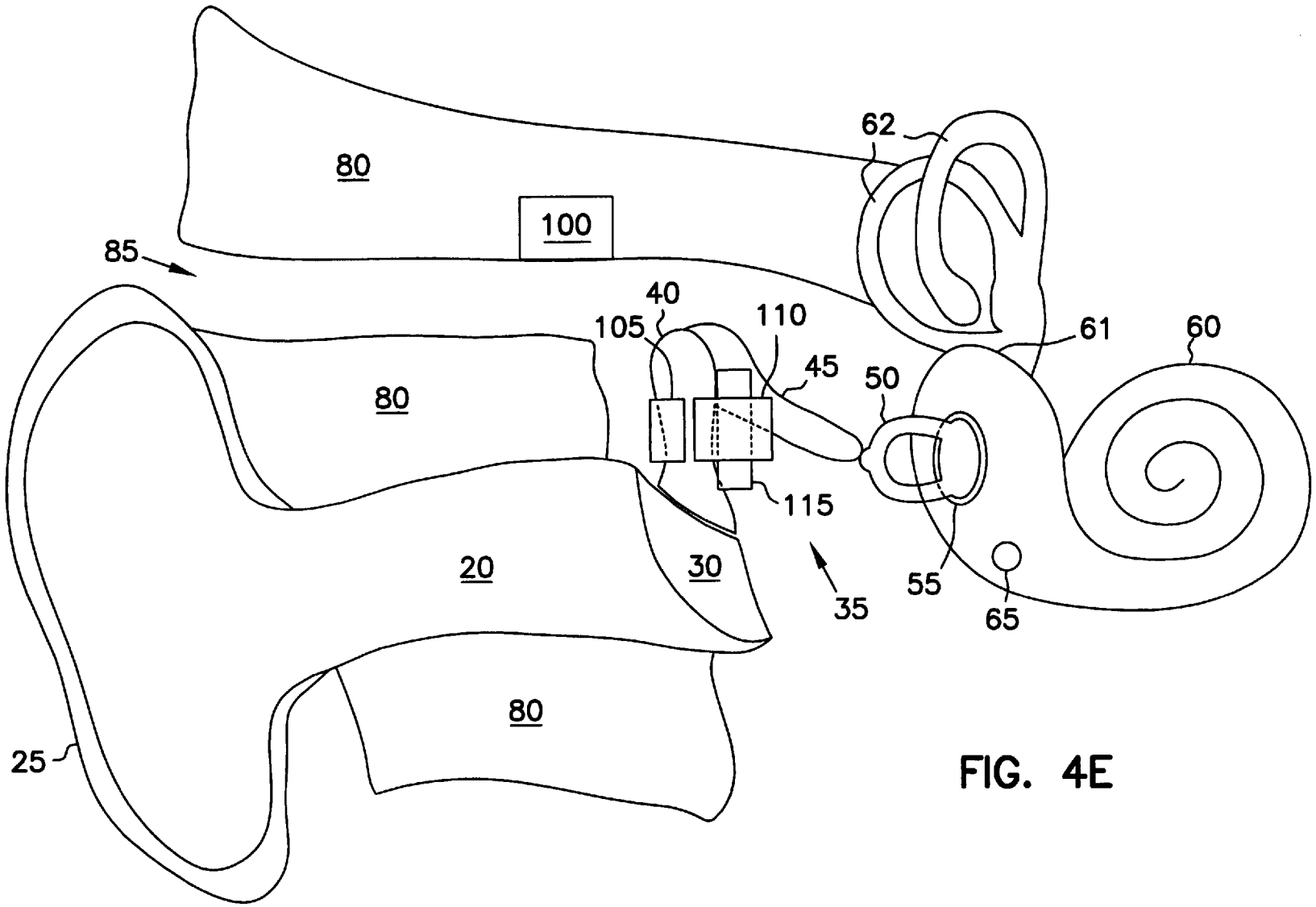
FIG. 4E is a schematic diagram of another embodiment, in which the transducer case is affixed between two permanent magnets and the malleus.
Figure 4F:
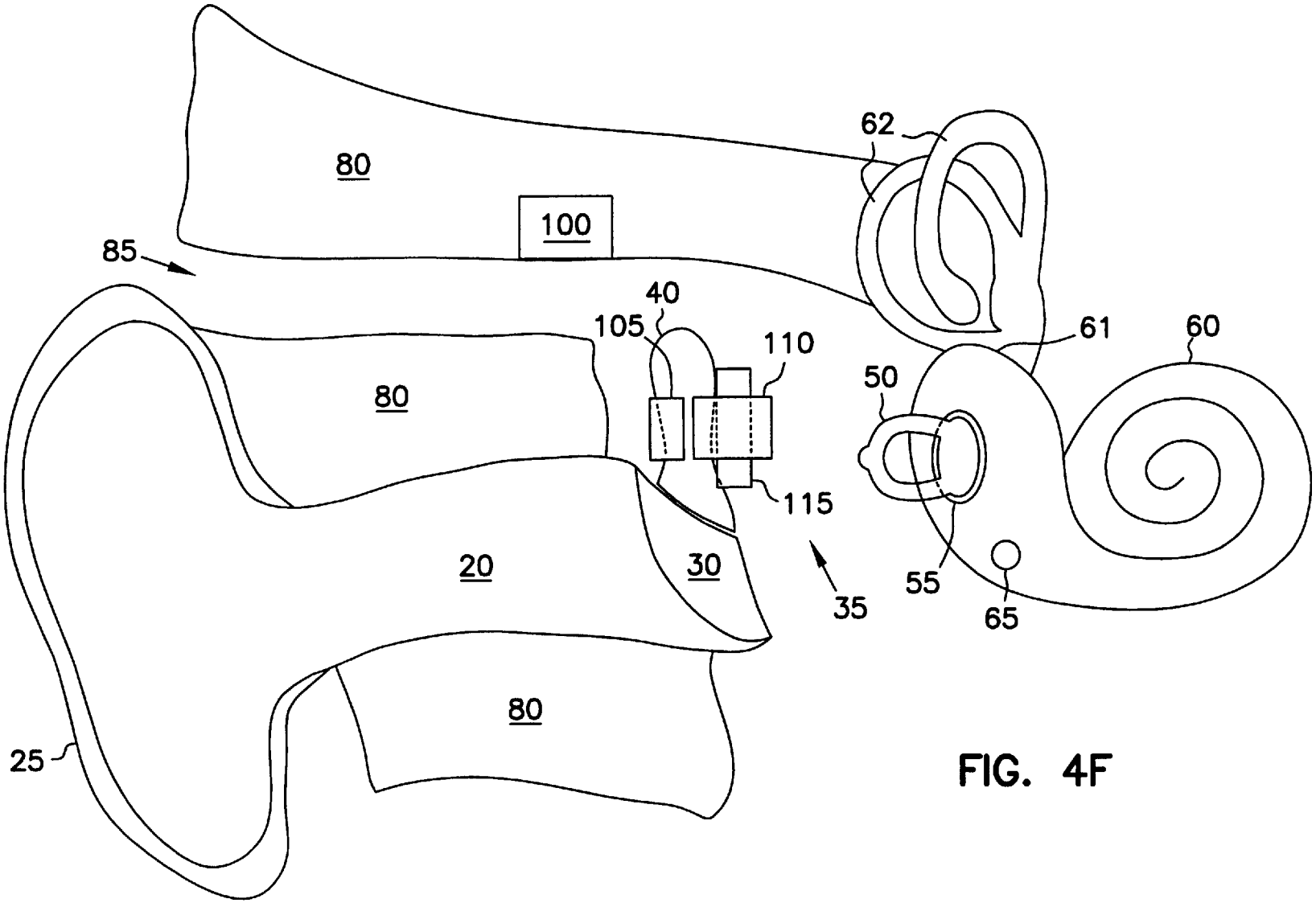
FIG. 4F is a schematic diagram of a further embodiment of the invention shown in FIG. 4E, in which the incus is removed.

In another further embodiment, as shown in FIG. 4E, the two permanent magnets 105 and 110 encircle the neck portion of the malleus 40. In yet a further embodiment, as shown in FIG. 4F, the incus 45 is removed to prevent mechanical feedback between the malleus 40 and the stapes 50. It is not necessary that the two permanent magnets 105 and 110 actually contact one another. It is sufficient for the two permanent magnets 105 and 110 to act on each other with a sufficient magnetic force to secure the transducer case 115 to the neck portion of the malleus 40. Since it is required that there be a close fit between the magnet 105, 110 and the ossicular chain element 40, 45, 50, it is preferable that the two permanent magnets 105 and 110 do not completely touch, so as to prevent movement once they are magnetically-coupled together and to ensure long-term compressive contact between the ossicular chain element 40, 45, 50, and the permanent magnets 105 and 110.

In further embodiments of the invention shown in FIGS. 4A to 4F, two locking permanent magnets 105 and 110 are used to further maintain the force of attraction and position between the two magnets 105 and 110 encircling the ossicular chain and transducer case 115. For example, as shown in FIG. 1 G, tubes 140 and respective slots 145 on mating ends of opposite magnets 105, 110 interlock around the ossicular chain. In an alternate embodiment, rounded knobs 150 and respective slots 155 on mating ends of opposite magnets 105, 110 interlock around the ossicular chain. In these embodiments, the magnets 105 and 110 also need not fully lock, so as to add further stability to the attachment.

Figure 5A:
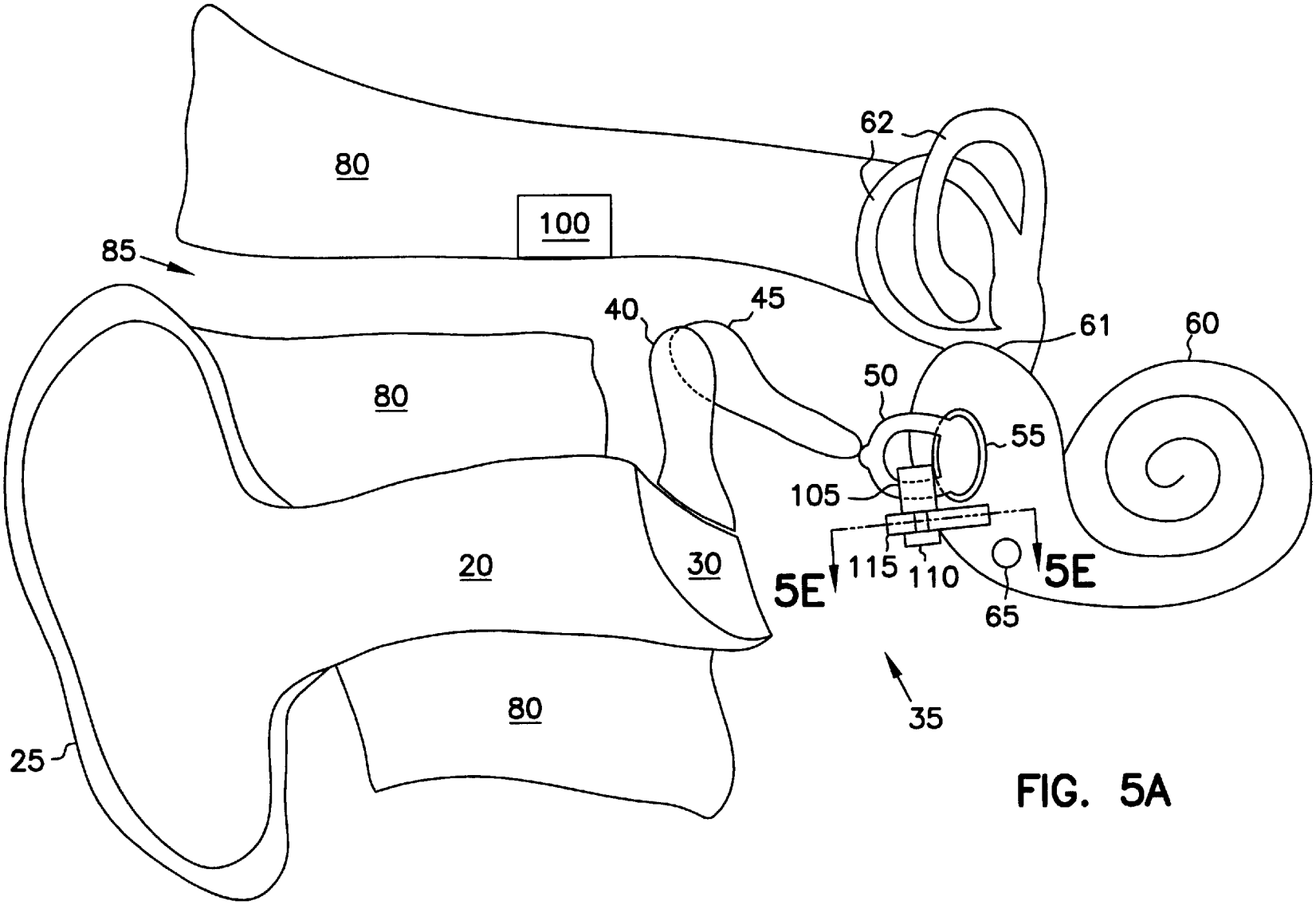
FIG. 5A is a schematic diagram of another embodiment, in which the transducer case is affixed to the stapes with a plurality of magnets, having respective interlocking pegs and slots.
Figure 5F:
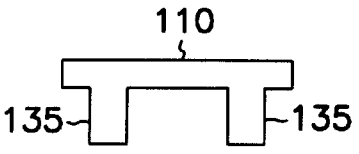
FIG. 5F is a side view of a further embodiment of the second permanent magnets shown in FIG. 5A.
Figure 5E:
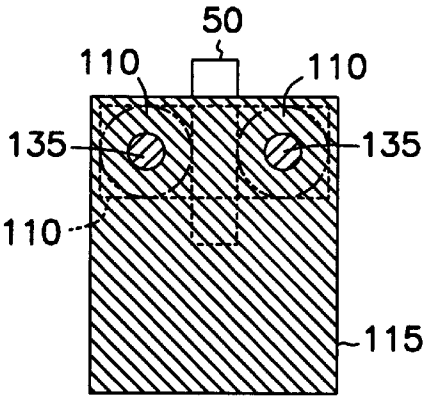
FIG. 5E is a plan view of the ossicular transducer attachment shown in FIG. 5A, taken along the plane C—C.
Figure 5D:
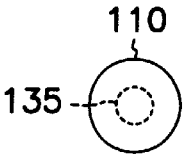
FIG. 5D is a top view of one of the two second permanent magnets shown in FIG. 5A.
Figure 5C:
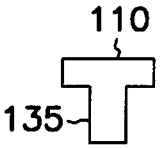
FIG. 5C is a side view of one of the two second permanent magnets shown in FIG. 5A.
Figure 5B:
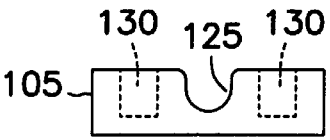
FIG. 5B is a side view of the first permanent magnet shown in FIG. 5A.

In another embodiment, as shown in FIG. 5A, a transducer case 115 is magnetically-coupled around the stapes 50, without using adhesives or requiring that the second permanent magnet 110 be encased in the transducer case 115, in order to attach the transducer case 115 to the second permanent magnet 110. A notch 125, as shown in FIG. 5B, is placed in the first permanent magnet 105 in order to fit around the stapes 50. Two peg-shaped permanent magnets 110, as shown in FIGS. 5C and 5D, or ball-shaped permanent magnets extend through the transducer case 115, into slots 130 contained in the first permanent magnet 105, as further shown in FIG. 5E. It is not necessary that two peg-shaped permanent magnets 110 be used. The two peg-shaped permanent magnets 110 are replaced with a single block magnet 110, having two posts 135 extending from one side in another embodiment, as shown in FIG. 5F. In the embodiments shown in FIGS. 5A to 5F, the transducer case 115 can be replaced with a piezoelectric film transducer, such as a polyvinylidene fluoride piezoelectric polymer sensor. The second permanent magnet(s) 110 can easily be pushed through punched holes in the film, without requiring a special transducer case 115.

In all embodiments, the type of permanent magnets 105 and 110 used in this invention is not critical, as long as it provides a sufficient magnetic force to secure the transducer case 115 to the ossicular chain element 40, 45, 50. Several different types of magnets provide adequate force to secure the transducer case 115 to the ossicular chain element 40, 45, 50. For example, samarium-cobalt ($SmCo_5$) and neodymium-iron-boron (NdFeB) magnets work well. The magnets 105 and 110 should be coated with a biocompatible material prior to their placement within the middle ear 35. In further embodiments, a flexible and/or conformable material is preformed on the contact surface of one or both of the magnets 105 and 110. A flexible material, such as low-durometer silicone, is advantageous to use because it would hold the magnet 105, 110 in place around the ossicular chain by conforming to the shape of the ossicular chain element 40, 45, 50, and creating friction between the material and the ossicular chain element 40, 45, 50. A conformable material is advantageous to use because it would also conform to the shape of the ossicular chain element 40, 45, 50, and create friction between the material and the ossicular chain element 40, 45, 50. Certain types of material can also solidify after implantation, adding further stability to the ossicular attachment. However, the flexible and/or conformable material should always be biocompatible.

We claim:

1. An apparatus adapted for mounting a transducer forming part of a hearing device to an ossicular element of a human ear by use of adhesive and magnetic fastener means comprising:

a first permanent magnet having adhesive means for attachment of the magnet to an ossicular element;

a second permanent magnet conformed to be spaced apart from and magnetically coupled to said first magnet, thereby cooperating with the first magnet to form a secure compressive magnetic band about the ossicular element; and a transducer, the transducer being a part of the hearing device, and being attachable to one of said first and said second magnets by one of either adhesive and magnetic fastener means for attaching the transducer, said transducer being hermetically sealed within a case.

2. The apparatus of claim 1, wherein one of said first and said second magnets is integrated with said case of the transducer.

3. The apparatus of claim 1, wherein said adhesive means for attachment is a non-magnetic substance.

4. The apparatus of claim 1, wherein said second permanent magnet comprises a structure configured as a ferromagnetic lining for the transducer case.

5. An apparatus adapted for mounting a hearing device to an ossicular element of a human ear having a disarticulated ossicular chain, the apparatus comprising:

a first permanent magnet attachable to [said remainder] an ossicular element;

a second magnet conformed to be spaced apart from and magnetically coupled to said first permanent magnet, the first and second magnets thereby forming a secure compressive magnetic band about said remainder ossicular element; and an auditory vibrations transducer attached to one of said first and said second magnets by one of either adhesive and mechanical fasteners.

6. A hearing aid apparatus including a transducer adapted for mounting to an ossicular chain element within a middle ear, the apparatus comprising:

a first permanent magnet attachable to an ossicular element by adhesive means for attaching the magnet;

a second permanent magnet spaced apart from and magnetically coupled to said first magnet, thereby forming a secure compressive magnetic band about the ossicular element; and a transducer attachable to one of said first and said second magnets by one of an adhesive and mechanical fasteners.

7. The apparatus of claim 6, wherein said first and said second magnets are structured as mating half rings spaced apart, said first and second magnets being remotely and magnetically coupled to provide a secure compressive magnetic band about the ossicular element.

8. The apparatus of claim 6, wherein the first magnet is U-shaped and is attachable to the ossicular element the adhesive means and wherein the transducer includes the second magnet integrated therewith, spaced apart and magnetically coupled to said U-shaped first magnet.

9. The apparatus of claim 6, wherein one of said first and said second magnets comprises a multiple prong magnet to provide the secure compressive magnetic band about the ossicular element.

10. The apparatus of claim 6, wherein one of said magnets is within a case of the transducer and further defines a notch in the case to further provide the secure magnetic band about the ossicular element.

11. The apparatus of claim 6, wherein the transducer is adapted for coupling to the second permanent magnet and is conformed to be magnetically secured between said first magnet and said second magnet, thereby adapted to be directly disposed against the ossicular element.

* * * * *